US009874855B2

(12) United States Patent
Lagorgette et al.

(10) Patent No.: US 9,874,855 B2
(45) Date of Patent: Jan. 23, 2018

(54) ELECTRONIC CLOCK MOVEMENT COMPRISING AN ANALOG DISPLAY OF SEVERAL ITEMS OF INFORMATION

(71) Applicant: ETA SA Manufacture Horlogere Suisse, Grenchen (CH)

(72) Inventors: Pascal Lagorgette, Bienne (CH); Vittorio Zanesco, Neuchatel (CH); Daniel Gruenig, Sugiez (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 15/301,657

(22) PCT Filed: Mar. 19, 2015

(86) PCT No.: PCT/EP2015/055763
§ 371 (c)(1),
(2) Date: Oct. 3, 2016

(87) PCT Pub. No.: WO2015/150086
PCT Pub. Date: Oct. 8, 2015

(65) Prior Publication Data

US 2017/0031320 A1 Feb. 2, 2017

(30) Foreign Application Priority Data

Apr. 3, 2014 (EP) ..... 14163345

(51) Int. Cl.
*G04B 19/253* (2006.01)
*G04B 19/247* (2006.01)
*G04C 17/00* (2006.01)

(52) U.S. Cl.
CPC ..... *G04B 19/25353* (2013.01); *G04B 19/247* (2013.01); *G04B 19/253* (2013.01); *G04B 19/25373* (2013.01); *G04C 17/0066* (2013.01)

(58) Field of Classification Search
CPC G04B 19/25; G04B 19/253; G04B 19/25353; G04B 19/247; G04B 19/25373; G04C 17/006
See application file for complete search history.

(56) References Cited

U.S. PATENT DOCUMENTS 3,704,583 A * 12/1972 Dome ..... G04B 19/25353 368/37
3,738,097 A * 6/1973 Vuilleumier ..... G04B 19/25366 368/37

(Continued)

FOREIGN PATENT DOCUMENTS

| | | |
|---|---|---|
| EP | 0 874 293 A2 | 10/1998 |
| FR | 2 453 439 | 10/1980 |
| JP | 54-1066 | 1/1979 |

OTHER PUBLICATIONS

International Search Report dated Oct. 21, 2015 in PCT/EP15/055763 Filed Mar. 19, 2015.

*Primary Examiner* — Sean Kayes
(74) *Attorney, Agent, or Firm* — Oblon, McClelland, Maier & Neustadt, L.L.P.

(57) ABSTRACT

An electronic clock mechanism includes an analog display device including a ring of dates and a stopwatch hand associated with a graduation of a small counter. The ring and hand are driven by a same electric motor via a permanent gear train, the hand being mounted on a wheel of the permanent gear train, the wheel arranged between a motor pinion and a movable element including a date driving wheel. The ring and date driving wheel respectively include two sets of teeth forming a permanent gear having a relatively large clearance to define a dead angle region for the date driving wheel as the ring is positioned by a jumper. The dead angle region is used to drive the stopwatch hand independently of the ring. The permanent gear train is (Continued)

arranged such that torque for positioning the rotor creates for the date driving wheel a blocking torque for shock-resistance.

10 Claims, 3 Drawing Sheets

(56) References Cited

U.S. PATENT DOCUMENTS

| | | | | |
|---|---|---|---|---|
| 4,060,977 | A * | 12/1977 | Rochat ..... | G04B 19/25<br>368/35 |
| 4,257,113 | A | 3/1981 | Meister et al. | |
| 6,088,300 | A | 7/2000 | Nakajima et al. | |
| 6,185,158 | B1 | 2/2001 | Ito et al. | |

* cited by examiner

ELECTRONIC CLOCK MOVEMENT COMPRISING AN ANALOG DISPLAY OF SEVERAL ITEMS OF INFORMATION

CROSS-REFERENCE TO RELATED APPLICATIONS

This is a National phase application in the United States of International patent application PCT/EP2015/055763filed Mar. 19, 2015 which claims priority on European patent application No. 14163345.3 filed Apr. 3, 2014. The entire disclosures of the above patent applications are hereby incorporated herein by reference.

FIELD OF THE INVENTION

The present invention relates to electronic clock mechanisms comprising an analogue display of multiple variable items of information.

More particularly, the present invention relates to an electronic clock mechanism comprising a device for driving an analogue display of at least two items of information which is actuated by one and the same electromechanical motor, at least one of said two items of information varying periodically or intermittently among a plurality of predefined discrete values. The information varying periodically or intermittently is in particular an item of date information and/or an item of information relating to a function/application which is selected from a plurality of possible functions/applications.

In the context of the present invention, the indicator of an item of information which varies periodically or intermittently is associated with a periodic or intermittent drive mechanism which is characterised in that it does not drive this indicator in each step or rotation of the rotor of the electromechanical motor actuating said drive mechanism. In particular, it is provided that the indicator of an item of information which varies periodically or intermittently is kept stationary in respective positions of the above-mentioned plurality of discrete values during intervals of time which are greater than a time period of the steps of a stepper motor which is provided to actuate the mechanism for driving said indicator.

BACKGROUND OF THE INVENTION

U.S. Pat. No. 6,185,158 in particular discloses an electronic watch which is equipped with an analogue display of multiple time variables, in particular the hour, the minute and the second by means of three coaxial hands which are located in the centre of the face of the watch. Furthermore, the analogue display comprises a stopwatch hand, in particular a minute hand indicating the measured interval of time, which is associated with a circular graduation over 360° as well as a ring of dates, the date conventionally appearing in a window of the face. This document proposes actuating the mechanism for driving the stopwatch hand (hereinafter referred to as the first mechanism), and the mechanism for driving the ring of dates (hereinafter referred to as the second mechanism) by one and the same electromagnetic motor. In the context of the described embodiment, it is provided that the first mechanism is not associated with the display of the current hour, minute or second, whereas the second mechanism must be of the type which is driven periodically or intermittently, as is the case for the display of the date.

The first mechanism comprises an intermediate wheel which is driven directly by the rotor of the motor and a chronograph wheel which meshes with the intermediate wheel. The second mechanism likewise comprises said intermediate wheel and further comprises an auxiliary wheel which meshes with said intermediate wheel. The auxiliary wheel is rigidly connected to a movable element for periodically actuating a wheel for driving the ring of dates, said movable element having a finger for actuating said drive wheel. The movable element for periodic actuation and the drive wheel together form a Geneva drive, which is known for periodically driving a ring/disc of dates. The Geneva drive is characterised by periodic driving of the wheel for driving the ring of dates, the movable element for periodic actuation meshing with said drive wheel only over a limited angular sector which is certainly less than 360°, while said movable element blocks the drive wheel over the complementary angular sector by means of a circular lateral surface. Thus, although the movable element for periodic actuation rotates while it is positioned in the complementary angular sector, the rotational movement of the rotor is not transmitted to the ring of dates.

The Geneva drive has at least two main functions. Firstly, this mechanism is designed to keep the wheel for driving the ring of dates, and thus the ring of dates, stationary over a specific angle distance from the movable element for periodic actuation (for example approximately 300°) as mentioned above. Secondly, this mechanism has a shock-resistance function when the drive wheel is stationary. Said drive wheel and the movable element for periodic actuation are arranged in such a way that the movable element for periodic actuation blocks any rotation of the drive wheel when said element is not setting said wheel into rotation. Since the meshing between the drive wheel and the set of teeth of the ring of dates is provided almost without any clearance (except for that of the conventional machining tolerances), the ring of dates is protected in the event of shock and remains, outside periods of driving which are provided for displaying the date, substantially in a stationary position during a shock.

In addition, U.S. Pat. No. 6,185,158 uses a Geneva drive to allow the motor used for driving the date to carry out an additional function, that is to say driving a stopwatch hand, as mentioned above. The method provided in this document consists in driving the stopwatch hand when the movable element for periodic actuation is in the non-actuation region thereof, i.e. in said complementary angular sector, and, at the end of the measured time interval, carrying out a reset in reverse to move the movable element for periodic actuation back to a predefined initial position. For this purpose, it is provided that the stopwatch hand normally carries out only one turn, and that the driving of said stopwatch hand over a whole turn leaves the movable element for periodic actuation in the non-actuation region thereof.

The concept of a multifunctional electromechanical motor making it possible to actuate the indicators of two independent items of information is advantageous because it makes it possible to reduce the number of motors and thus the bulkiness of the motor means in the clock mechanism. In addition, a clock mechanism of this type is less expensive. However, the device for driving the ring of dates and a stopwatch hand provided in U.S. Pat. No. 6,185,158 is relatively complex to produce. The production of a clock mechanism having such a mechanism is expensive because it is necessary to reduce as far as possible the machining and installation tolerances (production tolerances) of said mechanism and of the ring of dates to ensure the shock-resistance function and at the same time ensure positioning of this ring in the display positions thereof, for example centring of each date in the window of a face which is provided for the clock mechanism. The Geneva drive, in order to correctly ensure the functions thereof, must be machined with precision and installed in the clock mechanism whilst avoiding clearances between rotating parts, in particular so that two teeth of the drive wheel slide over the circular lateral surface of the movable element for periodic actuation in the above-mentioned non-actuation region. In addition, the Geneva drive does not ensure a shock-resistance function in the periods of driving the ring of dates, since said periods can be relatively long in a "trailing" drive device such as provided in U.S. Pat. No. 6,185,158.

SUMMARY OF THE INVENTION

The object of the present invention is to provide a clock mechanism comprising a first analogue indicator and a second analogue indicator for periodic or intermittent driving, which are both actuated by one and the same electromechanical motor, and of which the device for driving said first and second indicators provides in particular a solution to the above-mentioned problems from the prior art, i.e. that it is relatively simple, easy to install, and thus inexpensive to produce, whilst ensuring a precise display of the two items of information associated with the first and second indicators and an effective shock-resistance function at least for the second indicator for periodic or intermittent driving.

For this purpose, the invention relates to an electronic clock mechanism comprising:

- an analogue display device formed of a first indicator of a first item of information and a second indicator of a second item of information, said second item of information being of the type which varies periodically or intermittently, and being independent from the first item of information;
- a device for driving the analogue display device, which is formed of a first mechanism for driving the first indicator and a second mechanism for driving the second indicator, the second drive mechanism comprising a first set of teeth which is rigidly connected to the second indicator and a wheel for driving said second indicator which is equipped with a second set of teeth which meshes with said first set of teeth, said second drive mechanism being arranged so as to periodically or intermittently drive the second indicator between display positions from a plurality of predefined discrete display positions;
- an electric motor comprising a rotor which is coupled to said drive device by a motor pinion of said drive device, this motor pinion being connected to the rotor for conjoint rotation, said electric motor being arranged so as to actuate said first and second drive mechanisms and to drive said first and second indicators.

The first drive mechanism defines a first reduction between the rotor and the first indicator, and the second drive mechanism defines a second reduction between the rotor and the wheel for driving the second indicator, said second reduction being provided so as to be greater than the first reduction.

According to the invention, the second drive mechanism is formed by a train of gears which are each permanently meshed. The first and second sets of teeth then form a permanent gear which is arranged in such a way that, when the second indicator is in any discrete position from the plurality of discrete positions, the second set of teeth can undergo rotations within a dead angle range, the dead angle distance of said dead angle range being provided and the first drive mechanism being arranged in such a way that the first indicator undergoes, when the second set of teeth is set into rotation over the dead angle distance in the dead angle range, a movement during which said indicator sweeps the whole of a graduation which is associated with the display of the first item of information. The electronic clock mechanism further comprises a jumper, the function of which is to position the second indicator in each discrete position from the above-mentioned plurality of discrete positions, said jumper being arranged so as to apply a positioning force on the second indicator which is sufficient to position said indicator in each display position from the plurality of discrete display positions and to move said indicator back into a discrete display position which it occupied after an untimely displacement, if any, in particular during a shock, inside a clearance of the above-mentioned permanent gear corresponding to the dead angle range.

It will firstly be noted that a jumper which is arranged correctly relative to the set of teeth of a ring of dates allows very precise positioning of said ring, which is better than positioning by means of a Maltese cross in which the unavoidable or even necessary clearances of gears lead to a lack of precision in the positioning of such a ring of dates.

The present invention is notable in particular in that the above-mentioned second drive mechanism is formed by a train of gears which are each permanently meshed and in that the first indicator can be driven, to display a first item of information, inside a clearance which is provided in the permanent gear formed by the first set of teeth of the second indicator and the second set of teeth of the wheel for driving said second indicator, in such a way that the second indicator can remain stationary during the driving of the first indicator. In other words, the first indicator can be driven, in order to display a first item of information, while the second set of teeth is displaced in a dead angle range in which it does not drive the first set of teeth. Said dead angle range corresponds to a clearance in the above-mentioned permanent gear which is provided so as to be large enough to allow the first indicator to sweep the graduation which is associated therewith without the second indicator being displaced (the first and second indicators are thus independent) but still small enough that the first and second sets of teeth remain continuously meshed, i.e. without there being any disengagement regardless of the angular position of the wheel for driving the second indicator.

A "gear which is permanently meshed", which is also referred to as a "permanent gear", is understood to mean a gear formed by two sets of teeth in which a tooth from the first or second set of teeth which is located between two adjacent teeth from the second set of teeth, respectively from the first set of teeth so as to mutually block the rotation of the first and second sets of teeth by means of a stop, said tooth from the first or second set of teeth forming a stop for the two teeth from the other set of teeth when said other set of teeth is set into rotation respectively in one direction or the other, and said two adjacent teeth from the second set of teeth, respectively from the first set of teeth forming two stops for said tooth from the first or second set of teeth when said first or second set of teeth is set into rotation respectively in one direction or the other.

According to one main embodiment, the electric motor, the first drive mechanism and the second drive mechanism are arranged in such a way that the first indicator can be driven in both directions of the display mechanism thereof, and the wheel for driving the second indicator can be set into rotation in both directions, the first indicator being driven in a first direction when the wheel for driving the second indicator rotates in a first direction within at least a portion of the dead angle range and in the second direction when said drive wheel rotates in the second direction within at least a portion of the dead angle range, the first indicator being able to be driven from an initial position and return to said initial position while the wheel for driving the second indicator remains in the dead angle range.

According to one specific embodiment, the second drive mechanism is arranged in such a way that a maximum force, which can be applied tangentially to the first set of teeth during shocks which the clock mechanism must be able to endure, creates a torque on the wheel for driving the second indicator which is less than the blocking torque created by said drive wheel at least when said wheel is in a predetermined position while the second indicator is in any discrete position from said plurality of discrete positions. According to a preferred variant, the above-mentioned maximum force creates a torque on the wheel for driving the second indicator which is less than the blocking torque created by said drive wheel regardless of the angular position thereof.

Other specific features of the invention will be described hereinafter in the detailed description of the invention.

BRIEF DESCRIPTION OF THE DRAWINGS

The invention will be described hereinafter with reference to accompanying drawings, which are given by way of non-limiting example, in which.

DETAILED DESCRIPTION OF THE INVENTION

Figure 2:
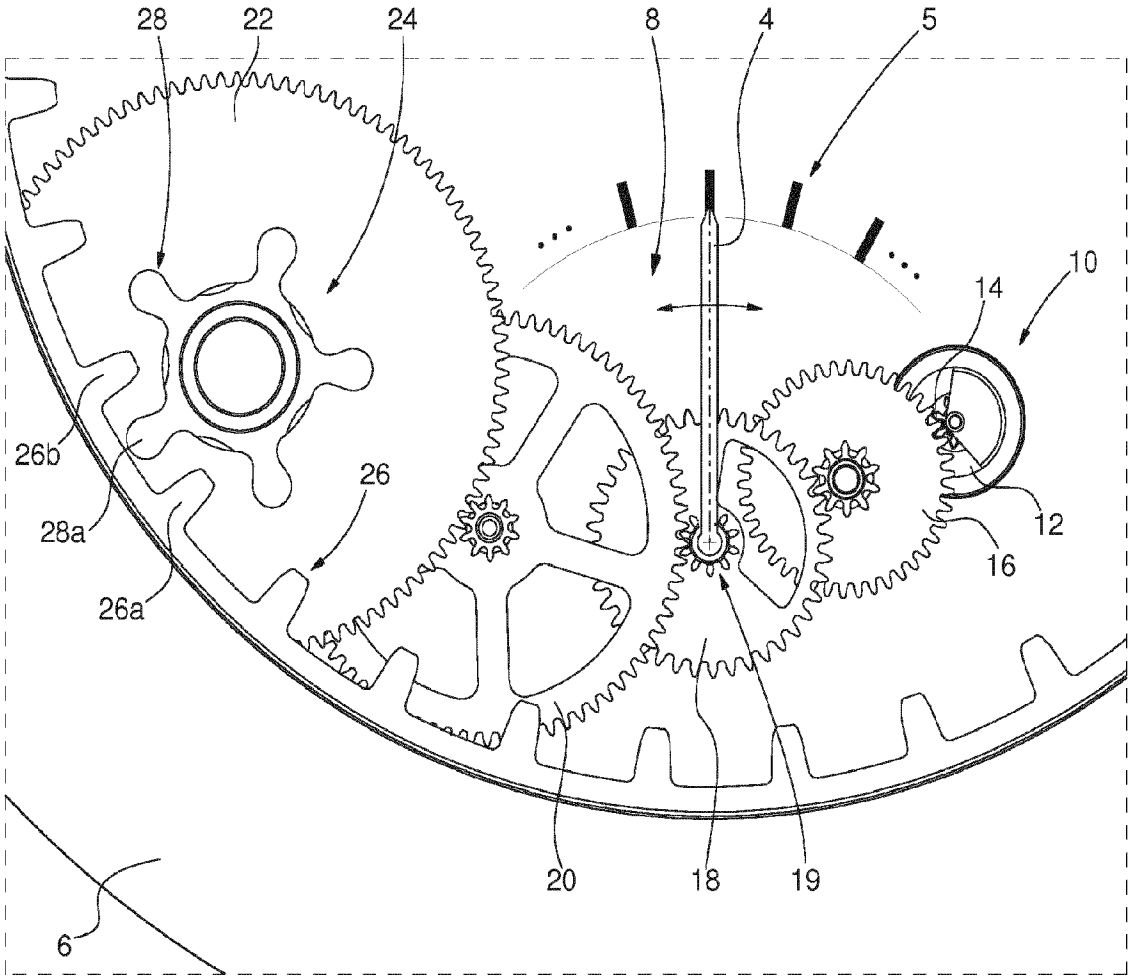
FIG. 2 is a partial enlargement of FIG. 1.
Figure 3:
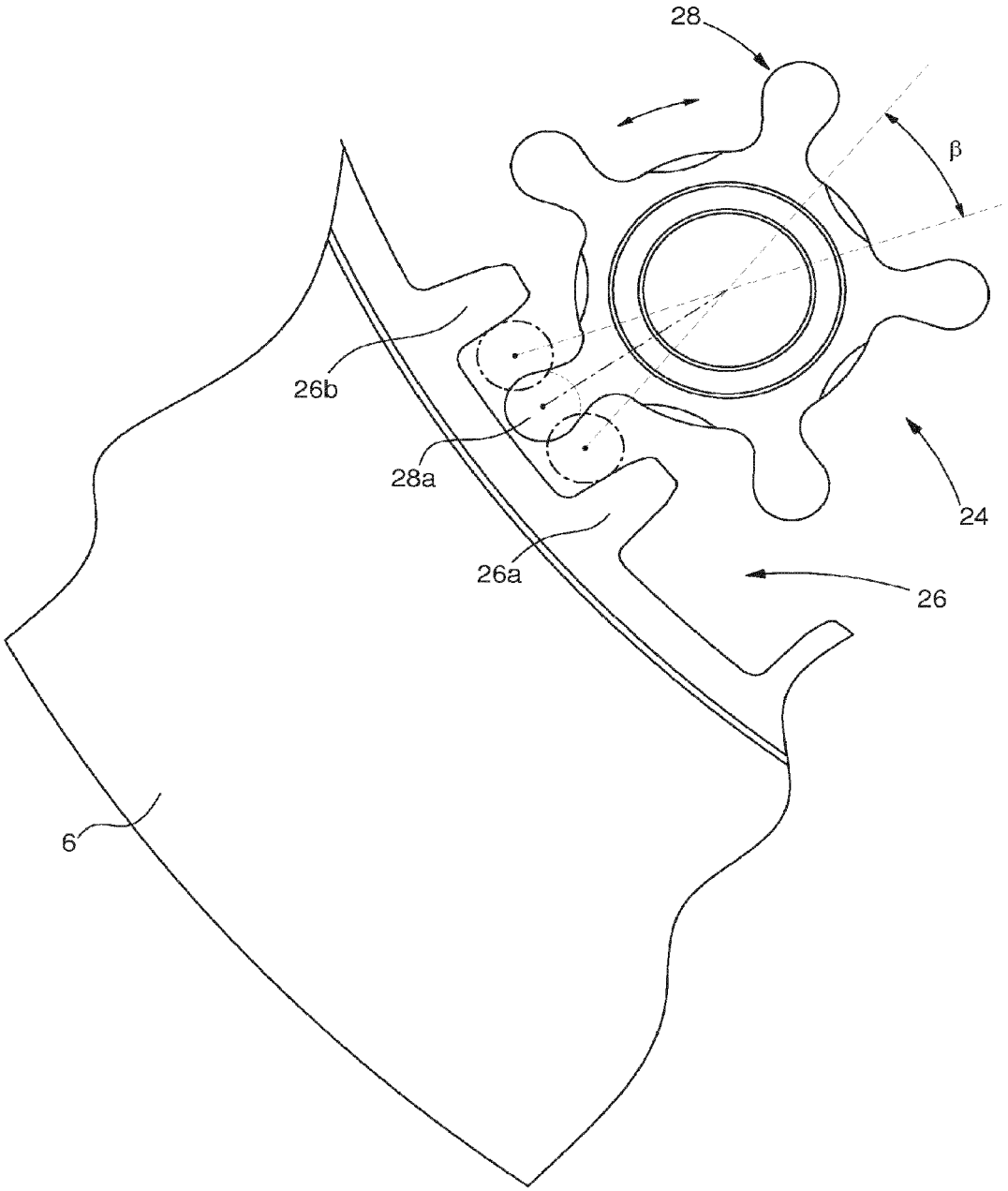
FIG. 3 is a partial enlargement of FIG. 2 to show in a more precise manner the wheel for driving the ring of dates and the dead angle range thereof for driving said ring of dates.

Hereinafter will be described, with reference to FIGS. 1 to 3, an embodiment of an electronic clock mechanism 2 according to the invention. Said electronic clock mechanism comprises an analogue display device which is formed of a first indicator 4 of a first item of information and a second indicator 6 of a second item of information, said second item of information being of the type which varies periodically or intermittently. In the variant shown, the first item of information is a timed interval of time, and the first indicator is a stopwatch hand which is associated with a small face which is arranged at 6 o'clock under the central axis of the clock mechanism. In particular, the hand is a hand of a 30-minute counter, the graduation 5 of which is partially shown in FIG. 2. In the variant shown, the second item of information is the indication of the date through a window of a face which is mounted on the clock mechanism, and the second indicator is a ring of dates (also referred to as a disc of dates). It should be noted that the two items of information from the given variant are in no way limiting. In particular, the second indicator can have, besides dates, various other indications which are linked to other functions, such as the indication of an operating mode from a plurality of modes. An "independent date" is thus referred to.

The clock mechanism 2 further comprises a device 8 for driving the above-mentioned analogue display device. Said drive device is formed of a first mechanism for driving the first indicator and a second mechanism for driving the second indicator. The first drive mechanism comprises a motor pinion 14, a first intermediate movable element 16 and a chronograph wheel 18, on the axis of which the stopwatch hand 4 is mounted. The second drive mechanism comprises, in the given variant, the first drive mechanism, a pinion 19 which is rigidly connected to the chronograph wheel 18, a second intermediate movable element 20 and an end movable element 22, the pinion 24 of which drives the ring of dates 6 by means of a set of teeth 26 which is arranged on the inner periphery of said ring. Clockmakers refer to the pinion 24 as the "date driving wheel", which is abbreviated to DDW. The date driving wheel 24 is equipped with a set of teeth 28 which meshes with the set of teeth 26 which are rigidly connected to the ring of dates. Generally, it is provided that the second drive mechanism periodically or intermittently drives the second indicator between discrete display positions from a plurality of discrete display positions. For this purpose, the second drive mechanism is associated with the electromechanical motor 10 which is controlled by an electronic control unit, said unit being able to be programmed to carry out this periodic or intermittent driving according to internal data such as the current time in order to drive the date and/or according to a signal generated by actuating a user interface and/or else by receiving an RF signal by means of the clock mechanism in a case in which said mechanism comprises an RF receiver.

The electromechanical motor 10, which is partially shown in the drawings, comprises a rotor 12 which is coupled to the drive device by the motor pinion 14 which is connected to said rotor for conjoint rotation. In the context of the invention, said motor is arranged so as to actuate the first and second drive mechanisms and to drive the first and second indicators. More particularly, it is provided that the motor 10 can drive the stopwatch hand 4, from an initial position which is shown in the drawings, over a specific angle distance, when the ring of dates is in any of the distinct display positions thereof, without said ring being set into rotation.

The drive device from the invention is notable firstly in that the second drive mechanism 8 is formed of a train of gears which are each permanently meshed. At no point is there any disengagement in the kinematic chain between the motor pinion 14 and the set of teeth 26 of the ring of dates. This feature makes it possible to obtain an effective and simple shock-resistance device for the ring of dates, as will be described in greater detail below. In a preferred variant, the set of teeth of the date driving wheel DDW is formed of at least four regularly arranged teeth. In the example shown in the drawings, the set of teeth 28 comprises five teeth having an angular pitch of 72°. It should be noted that, in one variant, the teeth are formed by axial pins. The invention is then notable in that, although the sets of teeth 26 and 28 form a permanent gear as defined previously, said sets of teeth are arranged in such a way that, when the ring of dates is in any discrete position from the above-mentioned plurality of discrete positions, the set of teeth 28 of the date driving wheel 24 can undergo rotations within a dead angle range (see FIG. 3), the dead angle distance 13 of said dead angle range being provided and the first drive mechanism for driving the stopwatch hand being arranged in such a way that it undergoes, when the set of teeth 28 of the DDW is set into rotation over the dead angle distance in the dead angle range, a rotation during which said stopwatch hand sweeps the whole of the circular graduation 5 which is associated with the display of the number of minutes of a timed period. Thus, in the case of a circular graduation, it is provided that the stopwatch hand can carry out at least one complete turn while the set of teeth of the DDW remains in the dead angle range. So that this is possible, the first drive mechanism has a first reduction R1 (transmission ratio of less than one) between the rotor 12 and the stopwatch hand, whereas the second drive mechanism has a second reduction R2 between the rotor 12 and the date driving wheel 24, said second reduction R2 being greater than the first reduction R1. As a reminder, the reduction of a reduction gear corresponds to a gear ratio of less than one.

In the variant shown in the drawings, the dead angle distance 13 lies between 30° and 36°, and the reduction R of the gear train forming the second mechanism between the pinion 19 which is rigidly connected to the chronograph wheel 18 and the date driving wheel 24 is between sixty and eighty ($60 \leq R \leq 80$). Said reduction R is equal to the ratio between R2 and R1, or R2 divided by R1 ($R=R2/R1$). Thus, the angle distance that the minute hand can travel, while the date driving wheel rotates by an angle β, lies in the angle range of from 1800° to 2880°, or between 5 turns and 8 turns of the circular stopwatch counter. It should be noted that the ranges for the dead angle distance and for the reduction R are given by way of example. If the minute stopwatch counter is provided with a circular graduation over 30 minutes, an interval of time of between 2 hours 30 minutes and 4 hours can be measured in the dead angle range of the DDW, without having to carry out a reverse movement of the stopwatch hand 4. In order to have a stopwatch hand which is independent of the ring of dates, i.e. a stopwatch hand which can be used for the stopwatch function without the electric motor actuating the ring of dates, said electric motor is provided so as to be two-way, and the gear train 8 is arranged in such a way that the date driving wheel can be set into rotation in both directions. In the embodiment described here, the gear train between the rotor of the motor and the date driving wheel DDW is provided substantially without any clearance in the gears (i.e. with a conventional clearance which is given substantially by the production and assembling tolerances to ensure correct meshing) and said gears are two-way. Since said gear train forms the whole drive mechanism of the stopwatch hand, the date driving wheel 24 and the chronograph wheel 18 with the stopwatch hand rotate in both directions simultaneously. Thus, more generally, the first and second drive mechanisms are arranged in such a way that the first indicator and the wheel for driving the second indicator rotate simultaneously in both directions of rotation.

Generally, in a preferred variant, the electric motor and the mechanism for driving the stopwatch hand are arranged in such a way that said stopwatch hand can be driven in both directions of the display mechanism thereof, the stopwatch hand being driven in a first direction when the date driving wheel DDW rotates in a first direction within at least a portion of the dead angle range of said DDW and in the second direction when said DDW rotates in the second direction within at least a portion of said dead angle range. The stopwatch hand is then mounted on the chronograph wheel in such a way that the initial position thereof corresponds to an angular position of the DDW within the dead angle range when the ring of dates is in any of the display positions thereof. These features make it possible to leave the stopwatch hand in the initial position thereof during the periods in which the ring of dates is stationary, and allow said stopwatch hand to return to this initial position when measuring a timed period and in particular once the measurement is finished while the date driving wheel remains in the dead angle range. This makes it possible to use the stopwatch hand independently of the date display, i.e. without disrupting this calendar information. In addition, the gear formed by the sets of teeth 26 and 28 is also two-way, and this makes it possible to drive the ring of dates in both directions and thus allow a modification of the date by a rotation in the opposite direction to that of the passage from one date to the next.

According to the invention, the electronic clock mechanism 2 further comprises a jumper 32, the function of which is to position the ring of dates 6 in each discrete display position from the plurality of discrete display positions thereof. Said jumper is arranged so as to apply a positioning force on said ring which is sufficient to position said ring in each discrete display position from the plurality of discrete display positions and to return said ring to a discrete position which it occupied after an untimely displacement during a shock. In the variant shown, the jumper 32, which is also referred to as a jumper spring, is formed of an arm 34 supporting at a first end a wheel 36 which is mounted on a pin 38, said arm pivoting about an axis at the other end. The jumper further comprises a spring 40 which exerts a force on the arm so as to create a positioning force on the set of teeth 26 of the ring of dates. When the ring moves away from a display position, and the jumper moves away from a corresponding stable or resting position, said positioning force has a tangential component acting on the set of teeth of the ring so as to either take the ring back to the display position thereof in the absence of a change in the discrete display position or, in an end phase, to take the ring to another display position while the display passes from one date to another.

In a first variant, the clearance between the first and second sets of teeth 26 and 28 is provided so as to be less than the maximum distance over which the jumper, which has been moved away from a stable resting position corresponding to a display position of the ring of dates by a displacement of said indicator, is capable of returning said indicator to said stable resting position by means of the positioning force which it exerts on the set of teeth of the indicator. In a second variant corresponding to that shown in the drawings, it is half the clearance with the addition of the cumulative production tolerances intervening in the gear, formed by said first and second sets of teeth, which is less than the maximum distance defined above. In this second variant, the two sets of teeth are arranged in such a way that, for the discrete display positions of the ring of dates, and when the stopwatch hand is in the initial position thereof, the tooth of one of these two sets of teeth which penetrates most deeply into the other set of teeth is substantially centred between two adjacent teeth of said other set of teeth, i.e. the clearance is distributed substantially equally on either side of the tooth which is inserted between these two adjacent teeth.

It should be noted that the jumper can also have a specific tolerance with respect to the display positions which it defines by the stable resting positions thereof in the first set of teeth 26. This tolerance is advantageously added to the cumulative production tolerances which intervene in the above-mentioned gear to define the clearance to be provided in the variants presented above. In a preferred variant, the position of the jumper can be adjusted after installing the indicator, in such a way that the discrete display positions are predefined in a precise manner, and the positioning tolerance of the jumper can be neglected.

In a preferred embodiment of the invention, the mechanism for driving the ring of dates is arranged in such a way that a maximum force, which can be applied tangentially to the set of teeth of said ring during shocks which the clock mechanism must be able to endure, creates a torque on the date driving wheel which is less than the blocking torque created by said wheel at least when said wheel is in a predetermined position for which the stopwatch hand is in the initial position thereof and when the ring of dates is in any discrete display position from the plurality of provided display positions. The mechanism for driving the ring of dates thus also has a shock-resistance function for said ring. A "shock-resistance function" is understood to mean not preventing the mechanism from breaking or being damaged in the event of shock, but rather preventing the indicator from permanently changing from a discrete display position to another as a result of a shock to which the clock mechanism must be able to be subjected (according to the standard NIHS 91-10, 91-20, 91-30 and other standards relating to this shock-resistance function).

In a preferred variant, the above-mentioned maximum force in the case of shocks creates a torque on the wheel for driving the ring of dates which is less than the blocking torque created by said drive wheel regardless of the angular position thereof. For this purpose, the feature according to which the sets of teeth 26 and 28 form a permanent gear (which are permanently meshed) is important.

In a main variant, the torque for blocking the date driving wheel results from a torque for positioning the rotor 12 of the electric motor 10 when said rotor is resting. In the case of a stepper motor, the stator is arranged so as to create a positioning torque which is applied to the permanent magnet rotor of said motor, which can be increased by a short circuit of the coil in particular in the case of a Lavet motor. This positioning torque keeps the rotor in at least one stable resting position (position adopted in the absence of a power supply). The motor can be configured so that the torque for positioning the rotor which is transmitted to the date driving wheel defines a blocking torque which is greater than the torque of maximum force which can be exerted by the indicator on said wheel, in particular during a shock. The gear reduction of the kinematic chain of the mechanism for driving the ring of dates is provided so as to be relatively large so that the blocking force is sufficiently high. It should be noted that the obtained blocking force depends not only on the positioning torque and the reduction factor of the kinematic chain, but also on the losses by friction in said kinematic chain, i.e. on the efficiency of each gear. By way of example, the ring of dates has an inertia which is equal to 17 $g \cdot mm^2$, and the maximum acceleration which said ring must endure during a shock is equal to 450 $krad/s^2$. If the permanent gear train of the drive mechanism has a reduction of 1/1836, and the efficiency of each of the four permanent gears is 90%, for the date driving wheel shown in the drawings, a blocking torque which is required for said wheel which lies between 0.10 Nm and 0.13 Nm and a corresponding motor torque in the range of from 14 nNm to 18 nNm are obtained. Since the positioning torque of a clock stepper motor is generally greater than 500 nNm, the shock-resistance function is largely ensured by the clock motor and the permanent gear train forming the mechanism for driving the ring of dates. The reduction of this permanent gear train can even be decreased, and in particular an intermediate wheel can be eliminated. With a lower reduction, it is possible to pass from one date to another more quickly.

In an advantageous variant, the force for positioning the jumper 32 is sized so as to ensure the positioning function of said jumper but is too small to ensure a shock-resistance function for the second indicator. The positioning force is thus provided so as to be less than a conventional minimum blocking force of the ring of dates in the event of a shock, so as to make it possible to set into rotation the ring with a torque force which is relatively low and to thus minimise the energy required to pass from one discrete display position to another. In one specific variant, the positioning force is firstly greater than a maximum friction force which is exerted by the clock mechanism on the ring 6 and secondly less than three times said maximum friction force. By way of non-limiting example, it has been observed that a conventional brass ring of dates having a diameter of 20 mm requires a torque of approximately 60 μNm to overcome the static friction force on the ring with the mechanism positioned in a flat manner. However, to ensure a shock-resistance function by means of the jumper as is generally the case in mechanisms from the prior art, the jumper must be able to exert a blocking torque of approximately 2000 μNm for such a ring. For a ring made of aluminium or plastics material, given in particular the lower moment of inertia, this shock-resistance torque will be lower, for example approximately equal to 800 μNm. Thus, in the advantageous variant presented here, with the ring made of steel, in one variant it is possible to size the spring 40 in such a way that the jumper 32 exerts a torque of between 120 μNm and 180 μNm. With the ring made of aluminium or plastics material, the torque exerted by the jumper will be for example of between 80 μNm and 120 μNm. It is noted that this variant makes it possible to greatly decrease the torque exerted by the jumper on the ring and thus the motor torque which the drive mechanism 8 must transmit. It is thus possible in particular to decrease the reduction in the mechanism for driving the ring of dates; and this makes it possible to pass from one date to another more quickly.

Figure 1:
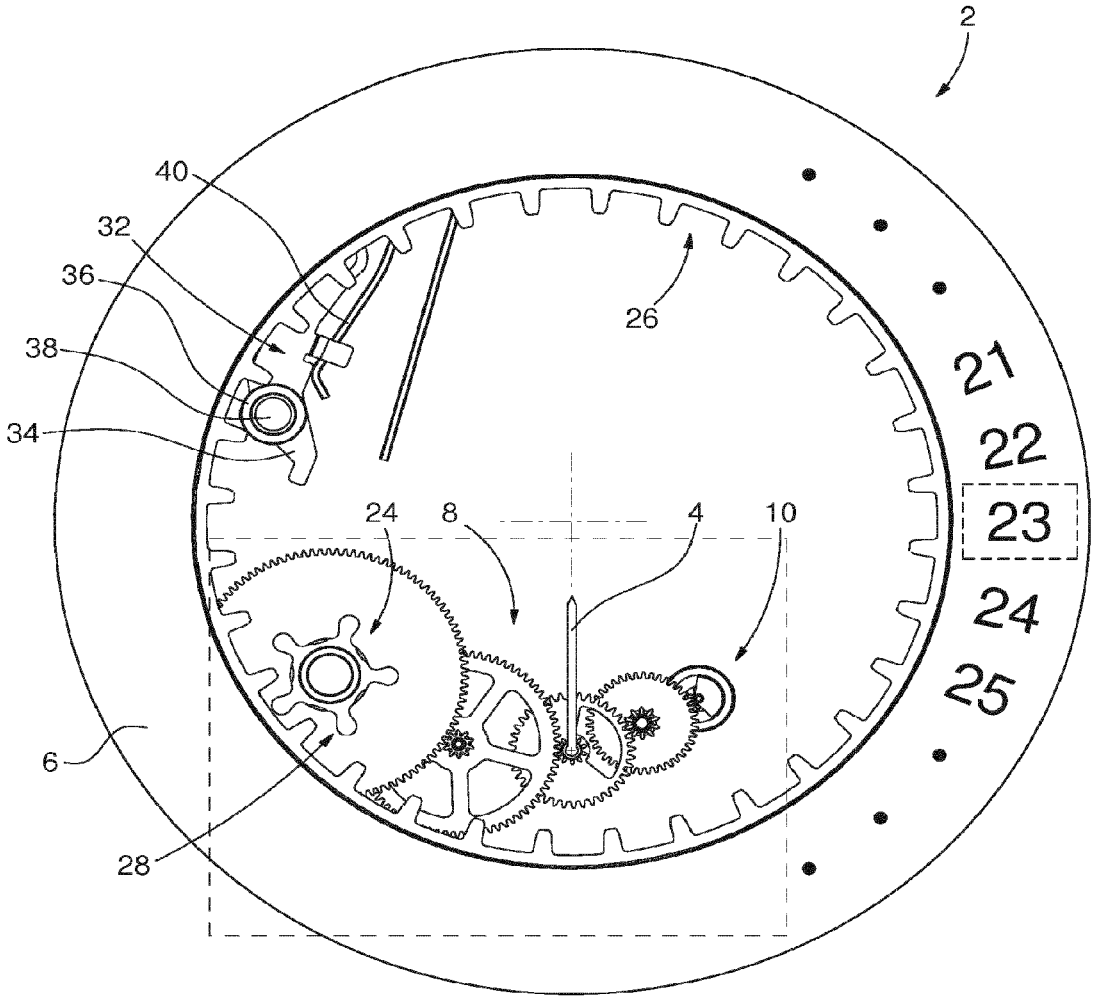
FIG. 1 is a partial view of an embodiment of an electronic clock mechanism.

In one specific variant, the jumper is arranged so as to rotate about an axis of rotation which substantially intercepts a tangent to a geometric circle which is defined by the set of teeth of the ring of dates at a central point at which said jumper exerts a radial force on said set of teeth, as is substantially shown in FIG. 1.

It is thus noted that the reduction between the rotor and the DDW as well as the reduction between the rotor and the chronograph wheel or, in the variant described previously with reference to the drawings, the reduction between the chronograph wheel and the DDW are selected so as to preferably find an optimum in these reductions in order to best satisfy three functions, namely 1) to make it possible to indicate a timed period on the circular face which is associated with the stopwatch hand in question without having to displace the ring of dates; 2) ensure a shock-resistance function for the ring of dates by means of the DDW; and 3) drive the ring of dates quickly enough during a passage from one date to another, the passage time being determined by the rotational speed of the rotor and the reduction between said rotor and the DDW.

In a specific variant shown in the drawings, when the second indicator 6 is positioned in any discrete position from the plurality of display positions provided for said second indicator, a tooth 28*a* from the second set of teeth 28 is located between two adjacent teeth 26*a* and 26*b* from the first set of teeth 26 so as to limit a movement of said first set of teeth in both directions by forming a stop respectively for said two adjacent teeth. The tooth 28*a* is then oriented substantially radially and located in the middle of the dead angle range defined previously. Such positioning is obtained by means of a control of the motor 10 which is associated with a monitoring of the pitches of the rotor making it possible to keep a copy in real time of the position of the date driving wheel and also of the position of the stopwatch hand. The motor control can additionally or alternatively be associated with a system for detecting the position of at least one wheel of the drive device. Lastly, the first mechanism for driving the first indicator 4 is arranged in such a way that the first indicator undergoes, when the second set of teeth is set into rotation over half of the dead angle distance, a movement during which it sweeps the whole of a graduation which is associated with the display of a first item of information.

In a first operating mode of the clock mechanism from the invention, as for the clock mechanism from U.S. Pat. No. 6,185,158 cited previously in the background of the invention, the maximum timed period is defined in such a way that the stopwatch hand can rotate in a clockwise direction during said maximum timed period, while the date driving wheel remains in the dead angle range, the ring of dates being kept stationary by the jumper. After measuring an interval of time, a reset function is provided, during which the motor 10 rotates the stopwatch hand in the opposite (anticlockwise) direction and in an accelerated driving mode over the angle distance which is travelled when measuring the interval of time in order to return said hand to the initial position thereof (the zero position on the graduation 5) and also return the date driving wheel to an initial position.

In a second operating mode of the clock mechanism from the invention which makes it possible to time greater periods, it is provided that, periodically during the timed period, the stopwatch hand is actuated in an accelerated mode in the opposite direction to carry out a complete turn or several complete turns with the deduction of the normal advance that said hand must carry out during said accelerated mode in the opposite direction. In one variant, the hand carries out a turn in the opposite direction for each time that said hand has carried out a turn in the clockwise direction. Thus, the date driving wheel travels a limited angle distance during an activation of the stopwatch mode and each turn of the stopwatch hand can be recorded by another counter of the clock mechanism.

The invention claimed is:

1. An electronic clock mechanism, comprising:

an analog display device including a first indicator of a first item of information and a second indicator of a second item of information, the second item of information varying periodically or intermittently, and being independent from the first item of information;

a device for driving the analog display device, including a first drive mechanism for driving the first indicator and a second drive mechanism for driving the second indicator, the second drive mechanism including a first set of teeth rigidly connected to the second indicator and a wheel for driving the second indicator including a second set of teeth that meshes with the first set of teeth, the second drive mechanism configured to periodically or intermittently drive the second indicator between discrete display positions from a plurality of predefined discrete display positions;

an electric motor including a rotor coupled to the drive device by a motor pinion of the drive device, the motor pinion being connected to the rotor for conjoint rotation, the electric motor configured to actuate the first and second drive mechanisms and to drive the first and second indicators;

the first drive mechanism including a first reduction between the rotor and the first indicator, and the second drive mechanism including a second reduction between the rotor and the wheel for driving the second indicator, the second reduction being provided to be greater than the first reduction;

wherein the second drive mechanism includes a train of gears each permanently meshed;

wherein the first and second sets of teeth form a permanent gear configured such that, when the second indicator is in any discrete position from the plurality of discrete positions, the second set of teeth can undergo rotations within a dead angle range, the dead angle distance of the dead angle range being provided and the first drive mechanism configured such that the first indicator can undergo, when the second set of teeth is set into rotation over the dead angle distance in the dead angle range, a movement during which it can sweep the whole of a graduation which is associated with the display of the first item of information; and the electronic clock mechanism further comprising a jumper, configured to position the second indicator in each display position of the plurality of discrete display positions, the jumper configured to apply a positioning force on the second indicator sufficient to position the second indicator in each display position of the plurality of discrete display positions and to move the indicator back into a discrete display position which it occupied after an untimely displacement or shock, if any, inside a clearance of the permanent gear corresponding to the dead angle range.

2. The clock mechanism according to claim 1, wherein the second set of teeth includes at least four teeth or pins.

3. The clock mechanism according to claim 1, wherein the electric motor, the first drive mechanism, and the second drive mechanism are configured such that the first indicator can be driven in both directions of its display movement, the wheel for driving the second indicator can be set into rotation in both directions, the first indicator being driven in a first direction when the wheel for driving the second indicator rotates in a first direction within at least a portion of the dead angle range and in the second direction when the drive wheel rotates in the second direction within at least a portion of the dead angle range; and wherein the first indicator can be driven from an initial position and return to the initial position while the drive wheel remains in the dead angle range.

4. The clock mechanism according to claim 3, wherein the first indicator is a rotating hand of a stopwatch display and the second indicator belongs to a display at least of the date, and wherein the first and second drive mechanisms are configured such that the first indicator and the wheel for driving the second indicator rotate simultaneously in both directions of rotation.

5. The clock mechanism according to claim 1, wherein the second drive mechanism is configured such that a maximum force, which can be applied tangentially to the first set of teeth during shocks which the clock mechanism can endure, creates a torque on the wheel for driving the second indicator which is less than a blocking torque created by the drive wheel at least when the wheel is in a predetermined position while the second indicator is in any discrete position of the plurality of discrete positions.

6. The clock mechanism according to claim 5, wherein the maximum force creates a torque on the wheel for driving the second indicator which is less than the blocking torque created by the drive wheel regardless of an angular position thereof.

7. The clock mechanism according to claim 5, wherein the force for positioning the jumper is sized to ensure the positioning function, but is too small to ensure a shock-resistance function for the second indicator.

8. The clock mechanism according to claim 5, wherein the train of gears which are permanently meshed are composed solely of two-way gears; and wherein the blocking torque of the drive wheel results from a torque for positioning the rotor of the electric motor when the rotor is resting.

9. The clock mechanism according to claim 5, wherein the jumper is configured to rotate about an axis of rotation which substantially intercepts a tangent to a geometric circle defined by the first set of teeth at a central point at which the jumper exerts a radial force on the first set of teeth.

10. The clock mechanism according to claim 1, wherein, when the second indicator is positioned in any discrete position of the plurality of discrete positions, a tooth from the second set of teeth is located between two adjacent teeth from the first set of teeth to limit a movement of the first set of teeth in both directions by forming a stop respectively for the two adjacent teeth;

wherein the clock mechanism is configured such that the tooth from the second set of teeth is oriented substantially radially and located in a middle of the dead angle range when no driving of the second indicator is provided; and wherein the first drive mechanism is configured such that the first indicator undergoes, when the second set of teeth is set into rotation over half of the dead angle distance, a movement during which it sweeps the whole of a graduation associated with display of the first item of information.

* * * * *